US006296404B1

(12) United States Patent
Pierce et al.

(10) Patent No.: US 6,296,404 B1
(45) Date of Patent: Oct. 2, 2001

(54) POSTAGE PRINTING SYSTEM HAVING LABEL PRINTING CAPABILITY

(75) Inventors: Perry A. Pierce, Darien; William T. Shannon, Shelton, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/433,481

(22) Filed: Nov. 4, 1999

(51) Int. Cl.[7] ..... B41J 5/30
(52) U.S. Cl. ..... 400/62
(58) Field of Search ..... 101/91, 288, 228, 101/66, 67; 400/61, 62, 76, 279

(56) References Cited

U.S. PATENT DOCUMENTS 4,065,117 * 12/1977 Thorsheim ..... 270/58
4,717,059 * 1/1988 Takahashi ..... 226/2
4,939,674 * 7/1990 Price et al. ..... 364/523
5,486,055 * 1/1996 Oka ..... 400/61
5,621,864 * 4/1997 Benade et al. ..... 395/117
6,010,156 1/2000 Block ..... 281/2

* cited by examiner

*Primary Examiner*—Ren Yan
(74) *Attorney, Agent, or Firm*—Angelo N. Chaclas; Michael E. Melton

(57) ABSTRACT

A method of producing a label for a mailpiece having a postal indicium printed thereon including the following steps: (i) providing a user with a label stock including a plurality of labels; (ii) prompting the user to provide an input of a label position indicator corresponding to a selected one of the plurality of labels; (iii) feeding the label stock through a printer; and (iv) printing the postal indicium on the selected label.

12 Claims, 5 Drawing Sheets

POSTAGE PRINTING SYSTEM HAVING LABEL PRINTING CAPABILITY

CROSS REFERENCE TO RELATED APPLICATIONS

This application is related to the following co-pending applications filed concurrently herewith and commonly assigned to the assignee of this application: U.S. patent application Ser. No. 09/433,482, entitled POSTAGE PRINTING SYSTEM HAVING GRAPHICAL RELATIONSHIP BETWEEN POSTAL INDICIUM LABEL AND ADDRESS LABEL SEGMENTS, which is specifically incorporated herein by reference.

FIELD OF THE INVENTION

This invention relates generally to postage printing systems. More particularly, this invention is directed to a postage printing system including a printer and a label stock having a plurality of labels where the label stock is adapted to be fed through the printer and includes a label position indicators for use by the postage printing system.

BACKGROUND OF THE INVENTION

Postage printing systems are well known in the art. A typical postage meter (one example of a postage printing system) includes an accounting structure and a printer so as to apply evidence of postage, commonly referred to as postal indicia, to an envelope or other mailpiece and accounts for the value of the postage dispensed. Generally, the accounting structure and the printer are integrated into the same housing and are dedicated devices. Examples of such postage printing systems are the PostPerfect® postage meter and the Paragon® II mail processor, both of which are available from Pitney Bowes Inc. of Stamford, Conn.

As is well known, postage meters include an ascending register, that stores a running total of all postage dispensed by the meter, and a descending register, that holds the remaining amount of postage credited to the meter and that is reduced by the amount of postage dispensed during a transaction. The postage meter generally also includes a control sum register that provides a check upon the descending and ascending registers. The control sum register has a running account of the total funds having been added into the meter. As a result, the control sum register must always correspond with the summed readings of the ascending and descending registers. Thus, the control sum register is the total amount of postage ever put into the machine and it is alterable only when adding funds to the meter. In this manner, by inspecting the various registers and securing them from tampering, the dispensing of postal funds may be accurately recorded, tracked and accounted for.

More recently, postage printing systems have been developed where the accounting structure described above is physically separated from the printer. In some postage printing systems, the accounting structure is not even resident with the user of the postage printing system. For example, in a "virtual postage meter" environment, the user does not possess a physical accounting structure as described above. Instead, postage is dispensed electronically over suitable communication channels (LAN, WAN, telephone lines, Internet, etc.) to a personal computer and printed using a general purpose office printer, such as those commonly available from Hewlett-Packard, Canon, Epson and others, attached to the personal computer. The user maintains an account with a remotely located data center (maintained by an authorized postage meter manufacturer) and receives postage securely using appropriate electronic data interchange techniques. At a later time, the user is invoiced for the amount of postage dispensed and any other fees associated with maintaining the account with the data center. In other types of postage metering systems, the user does maintain a small electronic device attached to a personal computer that services as the accounting structure described above. However, in both types of systems, the user utilizes the general purpose printer for printing postage indicia.

Oftentimes, a secret code or token is derived from information particular to the mailpiece (the indicated postage amount, date, recipient address information, etc.) and is incorporated or embedded into the postal indicium for later use by a postal authority in verifying the integrity of the postal indicium. Thus, the postal authority typically requires a correspondence between the postal indicium and its associated address. Examples of such systems are described in U.S. Pat. No. 4,725,718 and U.S. Pat. No. 5,454,038.

These types of postage printing systems require that the user feed the mailpiece through the general purpose printer so that a postal indicium may be printed thereon. In the case where the mailpiece is a standard size business envelope, such as a #10 envelope, this may be accomplished with relative ease once the idiosyncrasies of feeding envelopes through the printer (input location, orientation, registration, etc.) have been learned. On the other hand, other types of mailpieces, such as: small envelopes, oversized envelopes, thick envelopes, post cards, boxes, tubes, etc., are irregularly sized and cannot be fed through general purpose printers. Thus, other arrangements must be made to accommodate applying postage indicia to these types of irregular mailpieces.

To address this issue, it is known to print postage indicia on labels and apply the labels to the irregular mailpieces. Generally, the label stock may be fed through the general purpose printer to effect printing postage indicia. Alternatively, where increased productivity is desired, the general purpose printer may be replaced with a specialized label printer such as those commonly available from CoStar Corporation of Greenwich, Conn. or Eltron International, Inc. of California. An example of such a postage printing system including a specialized label printer is described in PCT patent application number PCT/US98/19688, entitled A COMBINATION ADDRESS AND POSTAGE LABEL AND SYSTEM FOR PRODUCING THE SAME, published on Apr. 1, 1999. In this system, blank adhesive label stock containing separable label segments is fed through the printer. Once the postal indicium, address and other data has been printed, the user separates the individual label segments and places them on a mailpiece.

Although a postage printing system including a specialized label printer works generally well, it suffers from certain drawbacks and disadvantages. First, the specialized label printer adds to the cost of the overall system. For some low volume users, this increased cost may not be acceptable. Second, the specialized label printer takes up additional space. In many small office and home offices, desk space is at a premium. Therefore, anything that takes up desk space and is only used sparingly is inefficient and gets pushed to the side.

Although a postage printing system including a general office printer where the label stock may be fed through the printer to effect printing postage works generally well, it also suffers from certain drawbacks and disadvantages. First, there is a risk that the user may not feed the label stock properly through the printer. The resulting jams and/or misprints cause the user to lose money because the postage is lost from failure to be applied correctly to the label. Second, if the user employs readily available label sheets including a plurality of labels, such as those commonly available from Minnesota Mining and Manufacturing Company of Minneapolis, Minn. or Avery Dennison Corporation of Pasadena, Calif., then a great deal of waste is created for several reasons. One reason is that the label sheets cannot be repeatedly fed through the printer as they tend to curl and become unusable. This is especially true with laser printers due to the heat generated by the fuser rollers. Thus, the user must often throw away the label sheet prematurely. Another reason is that it is difficult to direct the printing of the postal indicium to the correct location on the label sheet where a label still exists. For example, although Microsoft® Word includes a label printing utility, it is not user friendly for aligning the commencement of printing with the beginning of a label. More specifically, this general purpose word processing system requires that the user enter a row number and column number to commence printing. This is awkward for the user to obtain either by estimating or by measuring the label stock being used. Thus, the user may experience printing problems leading to lost postage.

Therefore, there is a need for an improved postage printing system for printing on label stock that provides safeguards for feeding the label stock and directing printing accordingly on the label stock. More particularly, there is a need for a postage printing system including a printer and a label stock adapted to be fed through the printer where the printer prints postal payment information on at a designated location corresponding to input received from the user and relating to the availability of labels on the label stock.

SUMMARY OF THE INVENTION

The present invention provides a method and a system for printing a label for a mailpiece and a label stock therefor. Generally, the present invention synchronizes printing of desired information on a selected label. In accordance with the present invention, a method of producing a label for a mailpiece having a postal indicium printed thereon including the following steps: (i) providing a user with a label stock including a plurality of labels; (ii) prompting the user to provide an input of a label position indicator corresponding to a selected one of the plurality of labels; (iii) feeding the label stock through a printer; and (iv) printing the postal indicium on the selected label.

In accordance with the present invention, a postage printing system and a label stock are also provided.

Therefore, it is now apparent that the present invention substantially overcomes the disadvantages associated with the prior art. Additional advantages of the invention will be set forth in the description that follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
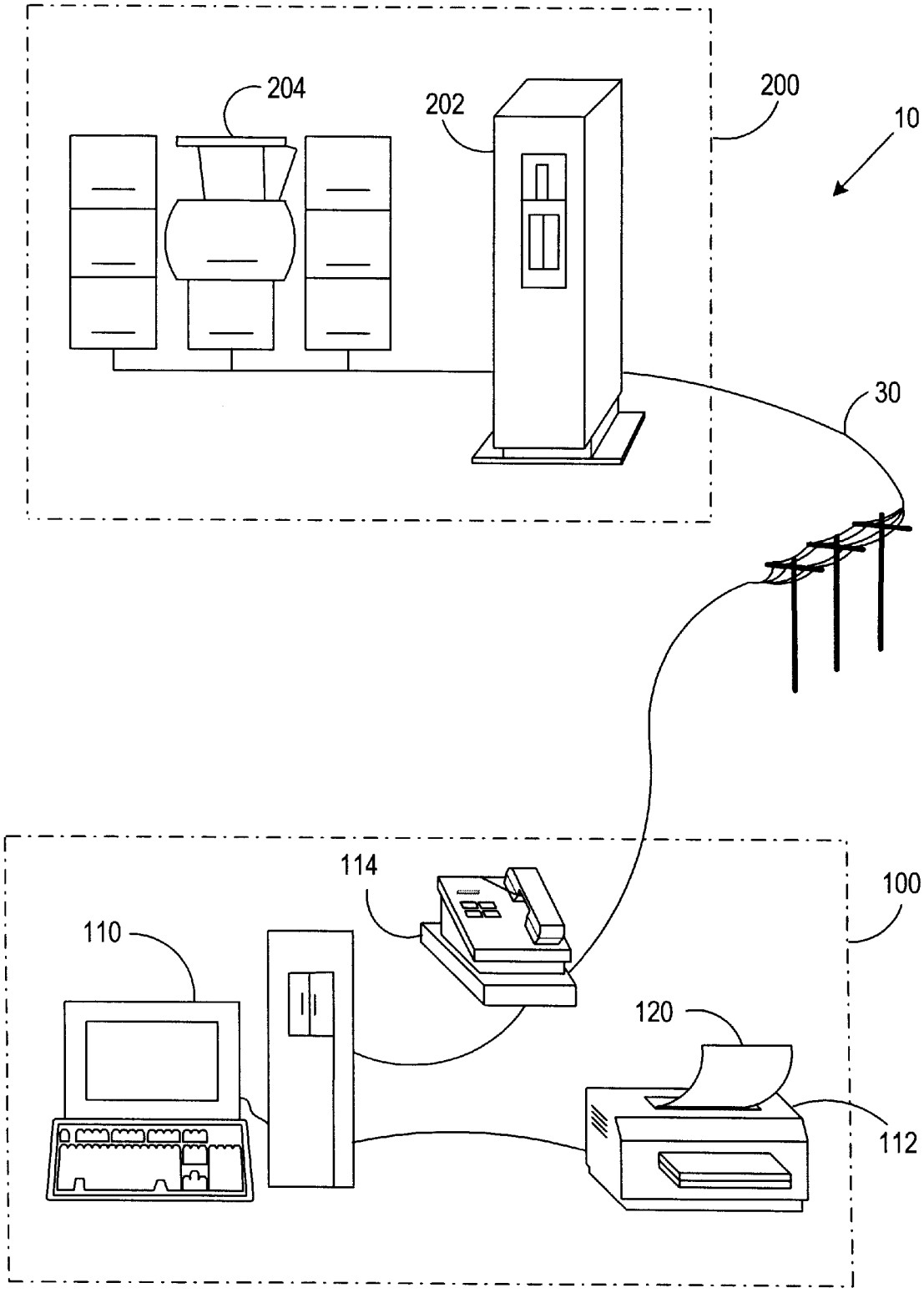
FIG. 1 is a simplified representation of a postage printing system in which the present invention may be incorporated.

Referring to FIG. 1, an example of a postage printing system 10, indicative of one example of a virtual postage metering environment, in which the present invention may be incorporated, is shown. The particular configuration of the postage metering functionality and the configuration of the postage indicium do not constitute a part of the present invention. Therefore, for the sake of brevity and clarity only minimal background and that which is necessary for an understanding of the present invention will be described. Generally, the postage printing system 10 includes a computer system 100 and a remotely located data center 200. The computer system 100 is in communication over any suitable communication network 30 (LAN, WAN, telephone line, Internet, etc.) with the data center 200. The computer system 100 may be comprised of any type of conventional computing and peripheral devices, such as: a personal computer, a virtual terminal, a workstation, a laptop computer, printer, modem or the like. In the preferred embodiment, the computer system 100 includes a personal computer 110 in operative communication with a printer 112 and a modem 114 for interfacing with the data center 200. The data center 200 includes a conventional computing device 202, such as a central server, and a database 204 for maintaining user account records.

Generally, it is anticipated that the computer system 100 may be located in small business offices and/or in private residences and used for a variety of purposes, including obtaining postage. Thus, the computer systems 100 are representative of users wanting to obtain postage for their mailpieces (envelopes, post cards, packages and the like). The data center 200 is maintained and operated by an authorized postage meter manufacturer, some other authorized agency or a postal authority. The computer system 100 may be connected directly to the printer 112 or have access to a printer 112 over any suitable communication network (not shown). Those skilled in the art will recognize that many computer systems 100 may be connected with the data center 200.

Figure 3:
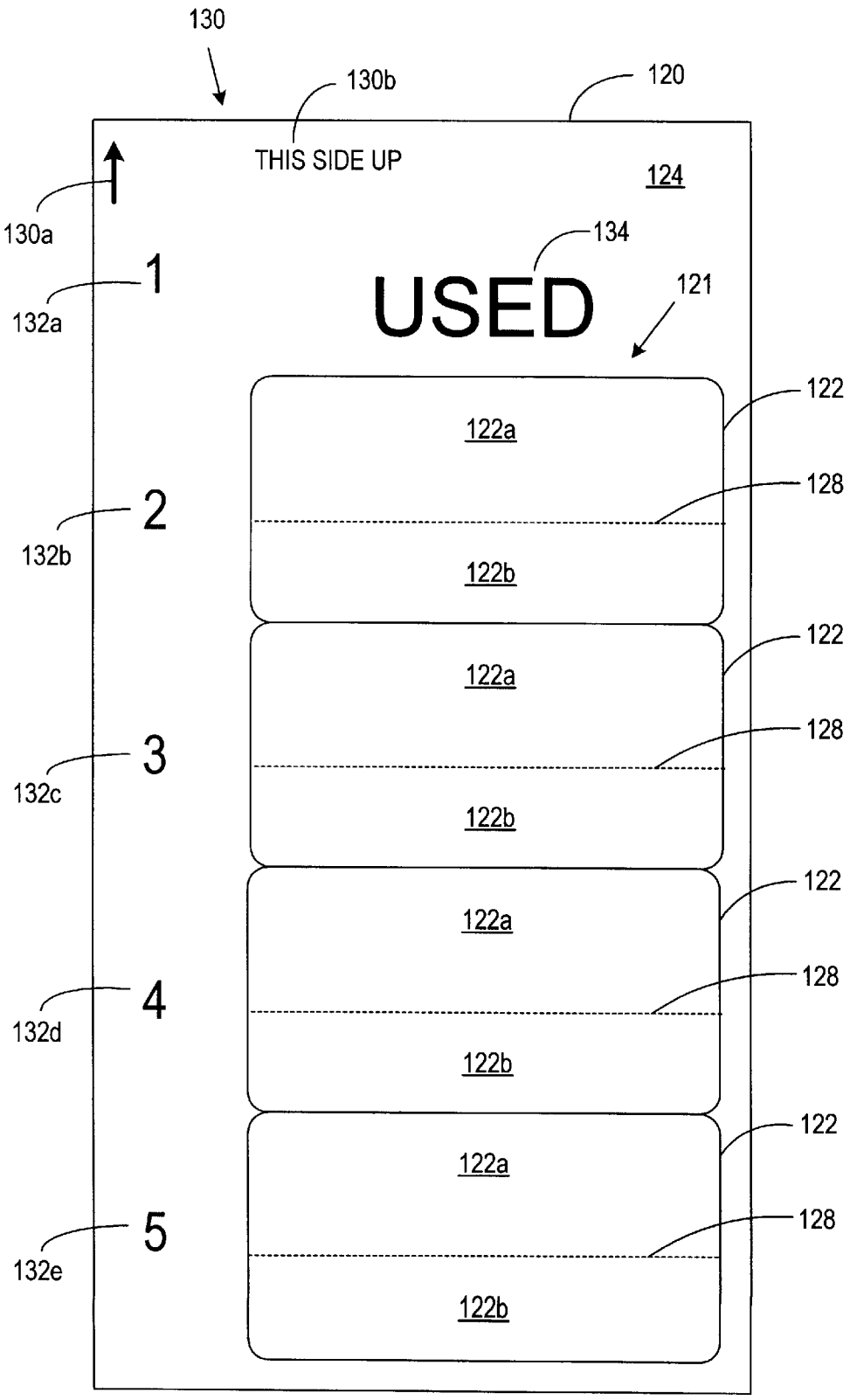
FIG. 3 is a front view of a label stock including a plurality of labels in accordance with the present invention.

Referring to FIGS. 1 and 3, in the preferred embodiment, the printer 112 is a general purpose office printer and may employ ink jet or laser printing technology, such as those commonly available from Hewlett-Packard and Canon. A label stock 120 is fed through the printer 112 and a postal indicium (not shown) is printed thereon. The label stock 120 includes an adhesive label layer 121 and a backing layer 124 where the adhesive label layer 121 is in contact with the backing layer 124 in conventional fashion. The adhesive label layer 121 includes a plurality of adhesive labels 122 that may be peeled away from the backing layer 124 and are die cut so as to fit end to end. Each of the plurality of adhesive labels 122 include a postal indicium label segment 122*a* and an address label segment 122*b* separated by a segment perforation line 128. Preferably, the label stock 120 is sized equivalent to a #10 envelope so that user will be familiar with its feeding into the printer 112. Also, it is preferable to make the label stock 120 out of suitable material so that the label stock 120 maintains its flexibility and durability even after repeated cycles through the printer 112.

The label stock 120 further includes a several visual indicators that may optionally be employed, either collectively or individually, to assist the user in feeding the label stock 120 through the printer 112 and locating the postal indicium (not shown) correctly on the label stock 120. The label stock 120 includes a label stock feed orientation indicator 130 that provides a graphical clue as to how the label stock 120 should be fed into the printer 112. The label stock feed orientation indicator 130 includes a first orientation indicator and a second orientation indicator. Preferably, the first orientation indicator is an arrow 130*a* showing an end of and a feed direction for inserting the label stock 120 into the printer 120. Preferably, the second orientation indicator is alpha string "THIS SIDE UP" 130*b* showing which layer of the label stock 120 should be facing the user. The label stock 120 further includes a plurality of label position indicators 132*a*–132*e* corresponding to the plurality of labels 122, respectively. The plurality of label position indicators 132*a*–132*e* are located adjacent to the plurality of labels 122, respectively, and show a preferred sequence for using the plurality of labels 122. In the most preferred embodiment, the label position indicators 132*a*–132*e* a sequential series of numbers. However, any numbers, letters, symbols or other devices that would differentiate the plurality of labels 122 may be employed. The label stock 120 further includes a label availability indicator 134 for each of the plurality of labels 120. The label availability indicator 134 is located on the backing layer 124 and underneath the plurality of labels 122, respectively, so that when a label 122 is removed, its corresponding label availability indicator 134 is visible. In the preferred embodiment, the alpha string "USED" serves as label availability indicator 134.

Figure 2:
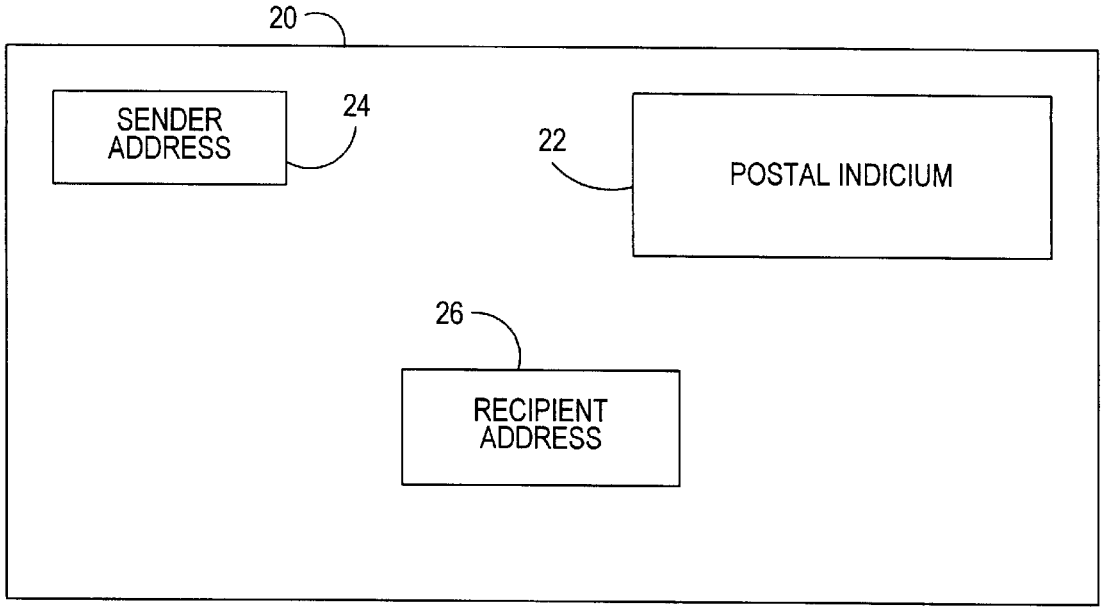
FIG. 2 is a front view of an envelope showing the available printing fields.

Referring to FIG. 2, an envelope 20 including representations of the various fields designated for printing is shown. Most typically, the envelope 20 includes a postal indicium 22, a sender address 24 and a recipient address 26. It is well known that the postal indicium 22 is subject to regulation by the relevant postal authority. Generally, the postal indicium 22 includes both fixed data (not shown) that does not change from mailpiece to mailpiece and variable data (not shown) that may change from mailpiece to mailpiece. The fixed data may include a graphic design, a meter serial number 32 uniquely identifying the postage meter or user account (not shown) and a licensing or receiving post office identifier such as a zip code (not shown). Generally, the variable data includes a date (not shown) indicating when the postage was dispensed, a postal value (not shown) indicating an amount of postage and other data (not shown) for use by the postal authority in verifying the authenticity of the postal indicium 22 using conventional techniques. However, those skilled in the art will recognize that the exact content of both the fixed data and variable data is subject to regulation by the postal authority and a matter of design choice. For example, in a virtual meter environment the meter serial number may not be used and the receiving post office identifier (zip code) may be variable data.

Figure 4:
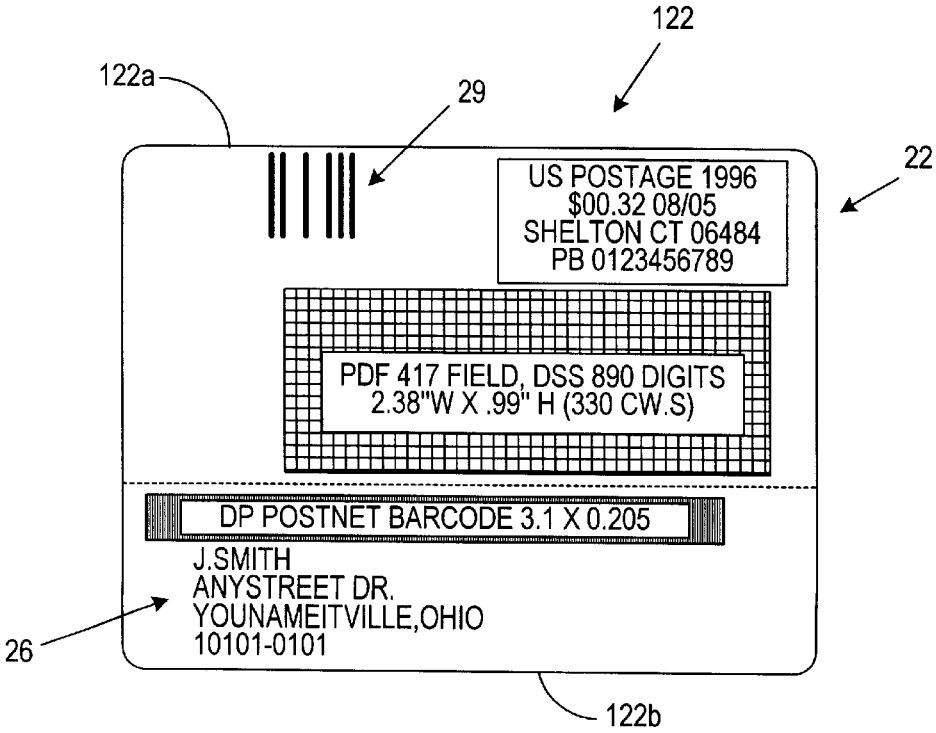
FIG. 4 is an enlarged view of a label including a postal indicium label segment and an address label segment in accordance with the present invention.
Figure 5:
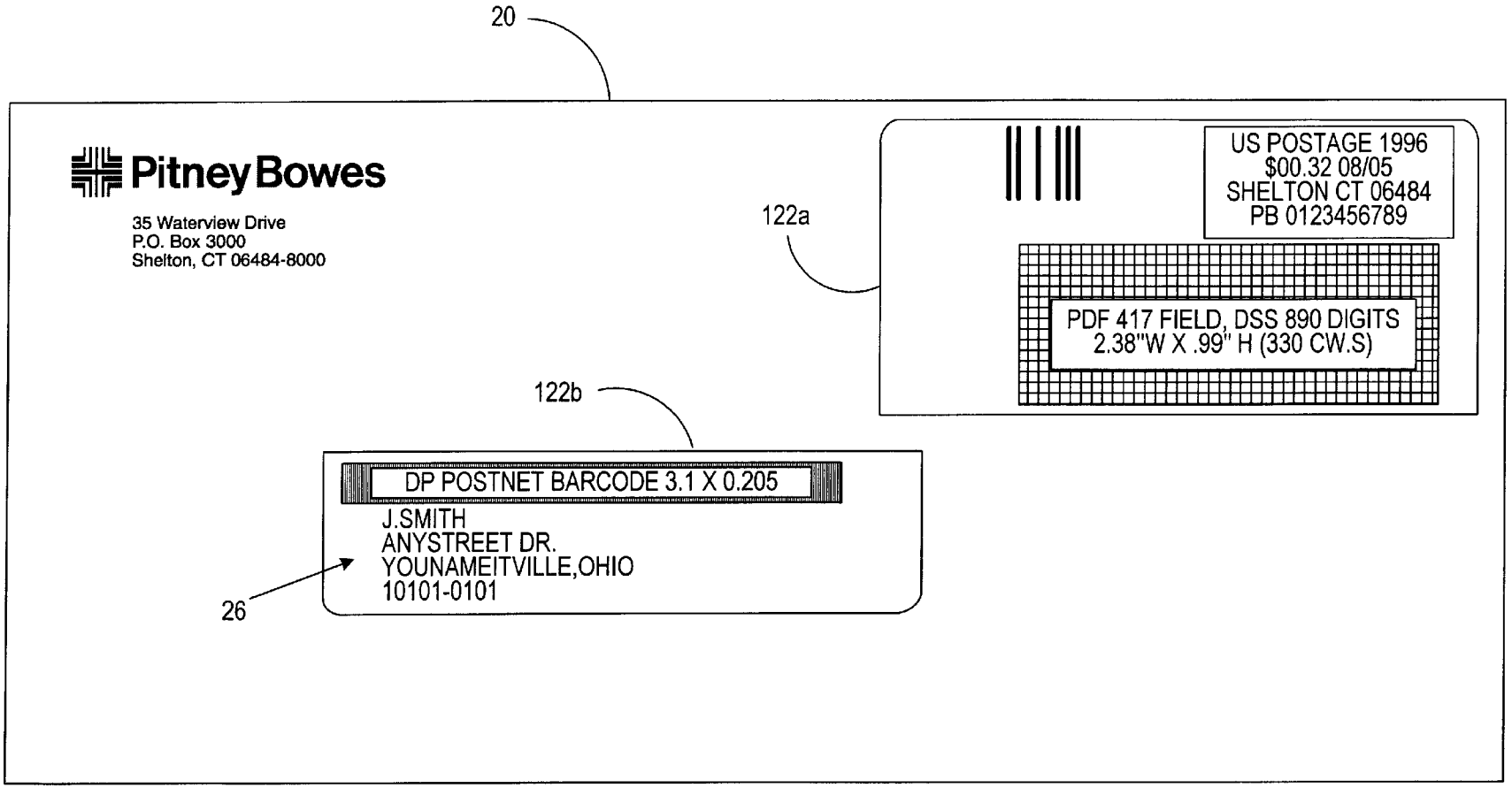
FIG. 5 is an envelope having the postal indicium label segment and the address label segment applied thereon in accordance with the present invention.

Referring to FIG. 4, a label 122 having a postal information printed thereon is shown. The postal indicium label segment 122*a* includes the postage indicium 22 and a facer identification mark (FIM) (not required by all postal authorities) 29. The address label segment 122*b* includes the recipient address 26. Referring to FIG. 5, an envelope 20 having the segments 122*a* and 122*b* assembled thereon is shown. Because the postal information has been printed on the label 122, the label segments 122*a* and 122*b* may be applied to either a normal mailpiece, as shown, or an irregular mailpiece as described above.

Figure 6:
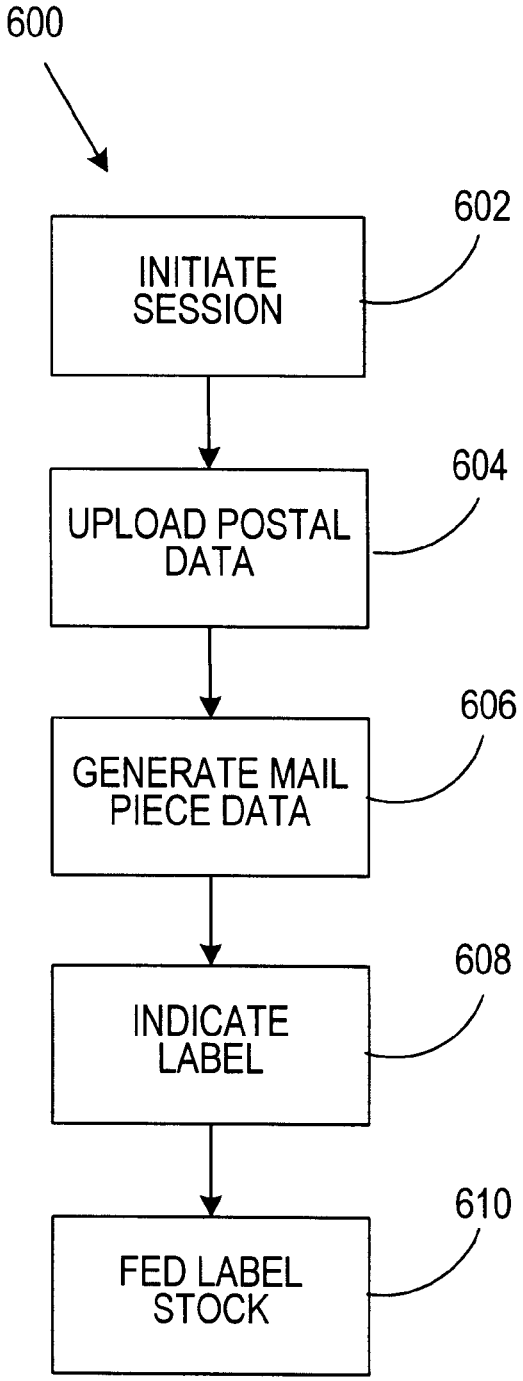
FIG. 6 is a flow chart of a routine for printing a label having the postal indicium label segment and the address label segment in accordance with the present invention.

With the structure of the postage printing system 10 described as above, the operational characteristics will now be described. Referring to FIG. 6, in view of FIGS. 1–5, a routine 600 describing the production of a mailing label 122 with respect to a particular virtual meter environment complying with the current requirements of the United States Postal Service is shown. At 602, using the computer system 100, the user initiates a transaction session with the data center 200. Once the user's identity and account have been verified by the data center 200 using conventional techniques, at 604, the user uploads a recipient address 26 and desired postage amount to the data center 200. Next, at 606, the data center 200 generates mailpiece data necessary to print the postal indicium 22 and the recipient address 26. This may involve performing address hygiene on the received recipient address 26 by comparing it against an address hygiene database (not shown). At this time, any misspelled words are corrected and any missing information (zip code or zip +4) is filled in to yield a hygiened or corrected recipient address 26. If the data center 200 cannot verify the integrity of the recipient address 26 received from the user, then the user may be instructed to resubmit it. Also, this typically involves the data center 200 generating an encrypted message (not shown), as is well known in the art for printing on the envelope 20, so that the postal authority may subsequently use the encrypted message for verification purposes.

Next, at 608, the user indicates to the computer system 100 which of the labels 122 should be used for printing. When the user picks up the label stock 120, it should be readily apparent from the label availability indicators 134 which labels 122 are present and available for printing. Using the plurality of label position indicators 132*a*–132*e*, the user selects a particular label 122 for printing thereon and inputs this selection to the computer system 100 by indicting a label position indicators 132*a*–132*e* corresponding to the selected label 122. The user may make this input by keyboard entry, mouse click or any other conventional technique.

Next, at 610, the computer system 100 prompts the user to feed the label stock 120 into the printer 112. Using the label stock feed orientation indicator 130 as a graphical clue, the user inserts the label stock 120 into the printer 112. In this manner, the printing on the selected label 122 is controlled by the computer system 100, in conventional fashion, so that printing is effected on the selected label 122 and not a location where the label 122 has already been removed or on the reverse side of the label stock 120. For example, because the label stock 120 is of a known size and the labels 122 are at known positions corresponding to the position indicators, the application software resident in the computer system 100 can synchronize feeding the label stock 120 with printing so as to commence printing on the label 122 indicated by the user. Once printing has completed, the user may apply the label segments 122*a* and 122*b* to the mailpiece.

Those skilled in the art will now recognize that the present invention substantially addresses the disadvantages associated with the prior art by helping users locate printing on the label stock 120 properly. As a result, users do not suffer lost postage due to print location errors. Also, the labels are not wasted in that each label on the label stock may be used.

Many features of the preferred embodiment represent design choices selected to best exploit the inventive concept as implemented in a particular postage printing environment employing a virtual meter concept and a general purpose office printer. However, those skilled in the art will recognize that various modifications can be made without departing from the spirit of the present invention. For example, the exact order of the steps in the routine described above is not material. As another example, the present invention may be employed in other postage printing systems where there is a resident postage meter. Therefore, a connection to the data center would not be necessary. As still another example, the present invention may be employed in other types of postage printing systems that do not require recipient address information. As still yet another example, the label position indicators may not be printed on the label stock, but instead are displayed on the computer system. The user may click on a graphical representation of the label stock that is shown on a display device of the computer system to indicate the position of the selected label.

The embodiments and alternative described above are intended to be illustrative of the concepts of the present invention and by no means should be considered exhaustive. Therefore, the inventive concept in its broader aspects is not limited to the specific details of the preferred embodiments described above, but is defined by the appended claims and their equivalents.

What is claimed is:

1. A postage printing system for printing a postal indicium, the postage printing system comprising:

a label stock including a plurality of labels, each of the plurality of labels including a label position indicator located on the label stock corresponding to a label position, respectively;

a computer system for interfacing with a user; and a printer operatively connected to the computer system for printing on the label stock; and wherein:

the computer system includes means for:

prompting the user to provide an input of the respective label position indicator corresponding to a selected one of the plurality of labels;

receiving from the user the input of the respective label position indicator;

prompting the user to feed the label stock through the printer; and using the respective label position indicator to locate the selected label on the label stock and print the postal indicium thereon.

2. The system of claim 1, wherein:

the label stock includes a feed orientation indicator as a graphical clue as to how the label stock should be fed into the printer; and the computer system includes means for prompting the user to feed the label stock through the printer in accordance with the feed orientation indicator.

3. The system of claim 2, wherein:

the label stock further includes a label availability indicator for each of the plurality of labels, respectively, indicating presence or absence; and the computer system includes means for prompting the user to use the label availability indicator to designate the selected one of the plurality of labels.

4. The system of claim 3, wherein:

the label position indicator is a number; and when the selected one of the plurality of labels is removed from the label stock, the respective label availability indicator is revealed.

5. The system of claim 4, wherein:

the label stock further includes a backing layer and an adhesive label layer in contact with the backing layer, the adhesive label layer including the plurality of labels; and the label stock feed orientation indicator includes a first orientation indicator showing an end of the label stock to be inserted into the printer and a second orientation indicator showing whether the backing layer or the adhesive label layer faces the user during feeding.

6. The system of claim 2, wherein:

the label stock further includes a backing layer and an adhesive label layer in contact with the backing layer, the adhesive label layer including the plurality of labels; and the label stock feed orientation indicator includes a first orientation indicator showing an end of the label stock to be inserted into the printer and a second orientation indicator showing whether the backing layer or the adhesive label layer faces the user during feeding.

7. A method of producing a label for a mailpiece having a postal indicium printed thereon, comprising the step(s) of:

providing a user with a label stock including a plurality of labels;

providing each of the plurality of labels with a label position indicator located on the label stock corresponding to a label position, respectively;

prompting the user to provide an input of the respective label position indicator corresponding to a selected one of the plurality of labels;

receiving from the user the input of the respective label position indicator;

feeding the label stock through a printer; and using the respective label position indicator to locate the selected label on the label stock and print the postal indicium thereon.

8. The method of claim 7, further comprising the step(s) of:

providing the label stock with a feed orientation indicator as a graphical clue as to how the label stock should be fed into the printer; and feeding the label stock through the printer in accordance with the feed orientation indicator.

9. The method of claim 8, further comprising the step(s) of:

providing the label stock with a label availability indicator for each of the plurality of labels, respectively, indicating presence or absence; and using the label availability indicator to designate the selected one of the plurality of labels.

10. The method of claim 9, wherein:

the label position indicator is a number; and further comprising the step(s) of:

removing the selected one of the plurality of labels to reveal the respective label availability indicator.

11. The method of claim 10, wherein:

the label stock includes a backing layer and an adhesive label layer in contact with the backing layer, the adhesive label layer including the plurality of labels; and the label stock feed orientation indicator includes a first orientation indicator showing an end of the label stock to be inserted into the printer and a second orientation indicator showing whether the backing layer or the adhesive label layer faces the user during feeding.

12. The method of claim 8, wherein:

the label stock includes a backing layer and an adhesive label layer in contact with the backing layer, the adhesive label layer including the plurality of labels; and the label stock feed orientation indicator includes a first orientation indicator showing an end of the label stock to be inserted into the printer and a second orientation indicator showing whether the backing layer or the adhesive label layer faces the user during feeding.

* * * * *